United States Patent [19]

Mall

[11] Patent Number: 4,648,337

[45] Date of Patent: Mar. 10, 1987

[54] WORK EDGE GUIDING DEVICE FOR SEWING MACHINE

[75] Inventor: Günther Mall, Kaiserslautern, Fed. Rep. of Germany

[73] Assignee: Pfaff Industriemaschinen GmbH, Fed. Rep. of Germany

[21] Appl. No.: 865,554

[22] Filed: May 20, 1986

[30] Foreign Application Priority Data

May 30, 1985 [DE] Fed. Rep. of Germany ..... 3519344

[51] Int. Cl.[4] ..... D05B 35/10

[52] U.S. Cl. ..... 112/153; 112/308

[58] Field of Search ..... 112/153, 308

[56] References Cited

U.S. PATENT DOCUMENTS

| | | | |
|---|---|---|---|
| 2,977,908 | 4/1961 | Winz et al. | 112/153 |
| 3,905,316 | 9/1975 | Mall | 112/153 |
| 4,181,085 | 1/1980 | Conner | 112/153 |
| 4,297,955 | 11/1981 | Shaw | 112/308 |

*Primary Examiner*—Ronald Feldbaum
*Attorney, Agent, or Firm*—McGlew and Tuttle

[57] ABSTRACT

An edge guiding device is provided for sewing work with several edges extending at angles to each other, and on which parallel seams are to be formed, e.g., collars. The device has an edge ruler which is formed by a central section and two sections controllable independently of the central section, each with a guide face. During the formation of seams which begin or end at inside corners of the collar or work, the edge ruler is moved synchronously with the work displacement. Thereby, e.g., one-piece collars plus collarbands can be securely guided from the start during the formation of the seam sections beginning or ending at the inside corners of the collars. For guiding at a long side of the collar, which is usually curved, the outer sections of the edge ruler are pulled back and only the central section with its arched guide face is used for guiding the work.

10 Claims, 6 Drawing Figures

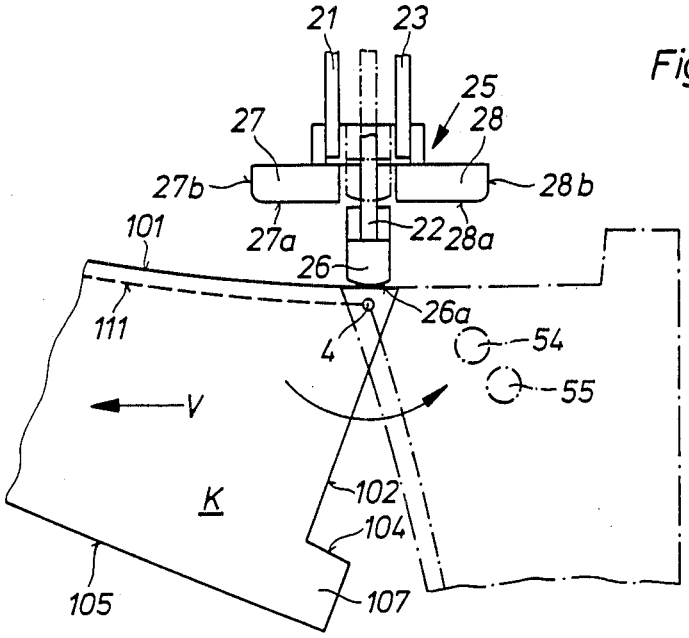
Fig. 5
Fig. 6
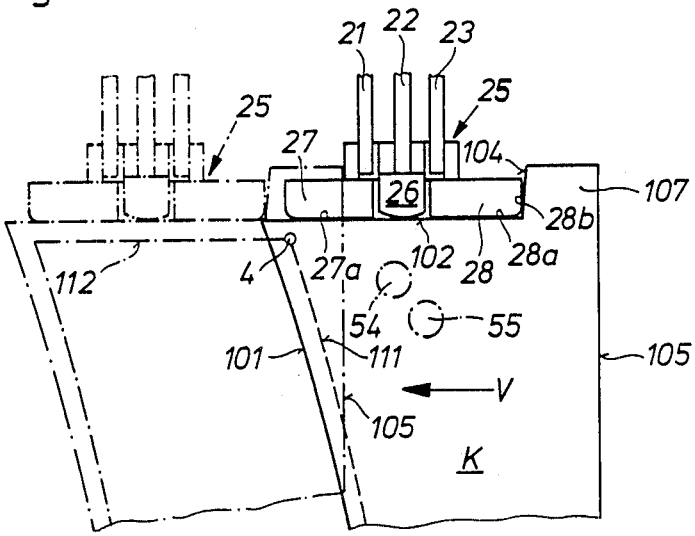

WORK EDGE GUIDING DEVICE FOR SEWING MACHINE

FIELD AND BACKGROUND OF THE INVENTION

The present invention relates in general to sewing machines and in particular to a new and useful edge guiding device for guiding edges of a workpiece having a plurality of edges extending at angles to each other on which parallel seams are to be sewn.

U.S. Pat. No. 2,977,908 discloses an edge guiding device wherein, when sewing the corners of collars or cuffs, the device is moved by an actuator from its active position into an inactive position transversely to the work feed direction. This is to allow the collar or cuff to be turned into the correct position, for the next following seam section, unhindered by the guiding edge device.

For certain seams, for example the seams between the collarband and the corner of the collar, the first of which is sewn from the collarband toward the corner and the seam opposite to it is sewn from the corner toward the collarband progressively, this known edge guiding device cannot be employed from the start of the sewing operation. This is because the protruding parts of the collarband provided for the buttonhole and for the button permit the edge guiding device to be brought to the collar edge only after the sewing of a certain seam distance. The guiding of the collar is therefore not possible at first during the sewing of the first seam. Later the collar can be guided only at the relatively short vertical guide face. For the seam to be formed along the long, usually curved collar edge between the guiding face and collar would be advantageous. When sewing the second seam advancing from the collar corner to the collarband, the edge guiding device must be taken out of its active position even before termination of the seam, so that the collar will be moving without positive guiding at an early stage.

A seamstress can attenuate these weak points during guiding of the workpiece by doing her own guiding. In automated systems, however, where the work is simply placed in readiness in proper orientation while the rest of the manipulation, including the seam formation, takes place automatically, the work must be guided continuously and be held under control exactly. Assistance by the operator is not possible here.

SUMMARY OF THE INVENTION

It is therefore an object of the present invention to provide an edge guiding device wherein the work or workpiece is guided and held under control duing the entire sewing process.

The edge guiding device of the invention, having been brought to an inactive position for unhindered insertion, e.g. of a collar with collarband cut as one, into the sewing machine with the presser foot raised, can be moved before the start of sewing into an active position selectable according to the type and form of the work. The device is thus available there as a guide for the work edges, from the start of the sewing operation and as close to the needle as possible. In one-piece collars with collarband cut as one, the guiding of the work starts at the inside corner at the edge extending toward the collar corner. Then, after turning the collar, guiding continues along the long outer edge of the collar, and thereafter up into the second inside corner at the collarband.

Accordingly another object of the present invention is to provide an edge guiding device for guiding a work or workpiece to be sewn, the work having edges extending at angles to each other which form at least one inside corner, and with seams that are parallel to the edges to be sewn onto the work, the device comprising an edge ruler with a guide face extending in a substantially vertical plane parallel to a work feed direction, an actuator connected to the edge ruler for moving it between active and inactive positions, the edge ruler being formed by a central section and two outer sections on opposite sides of the central section. The sections are independently controllable and each carries a portion of the guide face. The edge ruler is movable synchronously with displacement of the work during formation of the seams beginning or ending at one of the inside corners.

A further object of the present invention is to provide an edge guiding device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

An embodiment of the invention is described more specifically in the following with reference to the attached drawings showing the working of a one-piece collar with collarband that is cut as one piece. In the drawings:

FIGS. 3 to 6 are top partial views showing the various phases in the sewing of a one-piece collar with collarband.

DESCRIPTION OF THE PREFERRED EMBODIMENT

Figure 1:
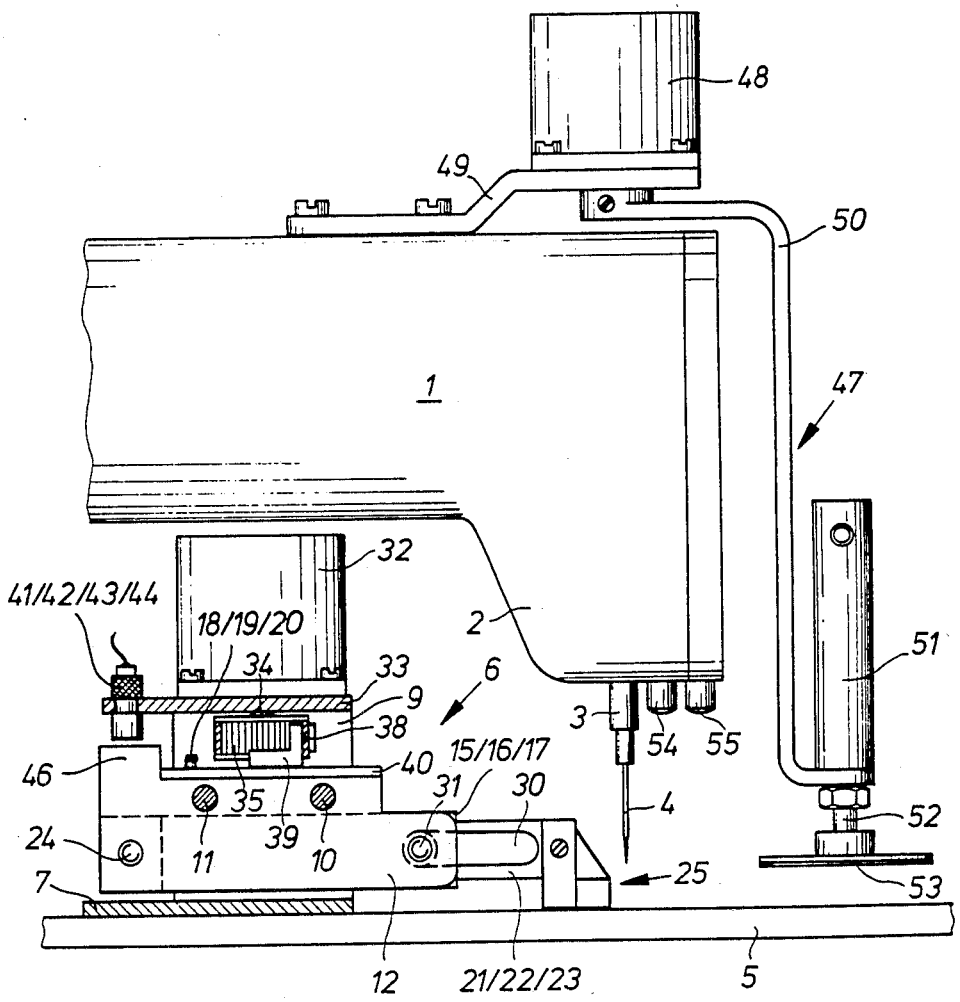
FIG. 1 is a side view of the edge guiding device and a turning device on a sewing machine that is shown only in part and simplified.

Referring to the drawings in particular, the invention embodied in FIG. 1 comprises a guiding device for a sewing machine 1 having a head 2 with a needle bar 3 movably mounted therein for up and down movement. A thread holding needle 4 is connected to the lower end of needle bar 3. Needle 4 cooperates with a stitch formation rotary hook or shuttle (not shown) disposed under a work support plate 5 of the sewing machine. For a clearer illustration, the usual presser foot has been omitted. The sewing machine 1 is driven by a known positioning motor, by which the machine can be stopped in certain positions, for example in a needleup position. It is also equipped with a known thread cutting device.

An edge guiding device generally designated 6 is disposed on a U-shaped mount 7 and screwed onto the work support plate 5. Fastened in side legs 8,9 of mount 7 (see FIG. 2) are two rods 10,11 which act as parallel guides for a slide-piece 12 which is U-shaped and has two perpendicular legs 13,14.

Three single-action pneumatic cylinders 15, 16 and 17 of rectangular cross-section and having compressed air nipples 18, 19 and 20 respectively are arranged between legs 13 and 14. The cylinders have piston rods 21, 22 and 23 to be actuated counter to the action of return springs (not shown) in the cylinder housing. Rods 21, 22 and 23 are each formed as a flat rod of rectangular cross-section. By a stay bolt 24 screwed into leg 13, the pneumatic cylinders 15 to 17 are firmly connected at one end to the slide piece 12, The cylinders form an actuator for an edge ruler 25.

To guide the work, the edge ruler 25 is formed by a central section 26 with arched guide face 26*a* and two outer sections 27, 28 movable independently of the central section 26. Each outer section has a guide face 27*a*, 28*a* and an additional one 27*b*, 28*b*, respectively, extending substantially transversely the guide faces 27*a* and 28*a* and serving as abutment for the edges 103 and 104 of the work K, originating from the inside corners, of the collarband projections 106 and 107 protruding over the edges 100 and 102, respectively.

The central section 26 of the edge ruler 25 is attached at piston rod 22 of pneumatic cylinder 16, while the outer sections 27 and 28 of edge ruler 25 are attached at the piston rods 21 and 23 of the pneumatic cylinders 15 and 17. The two outer sections 27 and 28 are controllable jointly, and the central section 26 of the edge ruler 25 is controllable jointly with the outer sections 27 and 28 and also independently of them if desired.

To limit the stroke of the piston rods 21 to 23 a longitudinal slot 30 (FIG. 1) is provided in them. Protruding through the slots 30 is a stop 31 screwed into leg 13 of slide-piece 12.

The slide-piece 12 is driven by a step motor 32 which is attached on a plate 33 screwed onto the legs 8 and 9 of mount 7. The output shaft 34 of step motor 32 protrudes through a bore in plate 33 downwardly. At the free end of the output shaft 34 a toothed belt pulley 35 provided with lateral flanges is secured. Looped around it and around a similar pulley 37 rotating about an axle 36 in plate 33 is a toothed belt 38 which is connected to the slide-piece 12 via a tappet 39 at a cover plate 40 screwed onto the legs 13 and 14 of slide-piece 12.

For the control of certain operating positions of the edge guiding device 6, four proximity switches 41 to 44 are provided, which are arranged to slide in a longitudinal slot 45 and to be fixed on the plate 33. These switches cooperate with a switch bar 46 of leg 13 of the slide-piece 12 for stopping the step motor 32 and hence the edge guide 6 in certain ones of the positions shown in dashed and dash-dotted lines in FIGS. 2 to 6. The respective positions of bar 46 of slide-piece 12 are marked in FIG. 2 by letters A to F. The position of edge ruler 25 shown in solid lines in FIG. 3 corresponds to the C mark in FIG. 2, while its position shown in dash-dot lines in FIG. 6 corresponds to the F mark in FIG. 2. These two positions of the edge guiding device 6 are controlled by a sequential control for various other functions. Position A of ruler 25 is shown in dash-dot lines in FIG. 2. It is the starting position of the step motor 32 and hence of the edge guiding device 6 for the following cycle. This starting position A is determined by proximity switch 41, position B by proximity switch 42, position D by proximity switch 44, and position E by proximity switch 43. Alternatively the movements of the edge ruler 25 may be controlled by a programmable computer.

For rotating the collar K after the sewing machine has been stopped in a needle down position at the collar corners, a rotating device 47 is used which has a step motor 48 which is arranged at a support 49 attached to the housing of the sewing machine 1 and drives a rotary arm 50, at the lower end of which a single-action pneumatic cylinder 51 is fastened, the piston rod 52 of which carries a pressure piece 53 for entrainment of the collar K by friction.

For the work-dependent control of the sewing machine 1, of the rotating device 47 and of the edge guiding device 6 at the end of the seam lengths 110, 111 and 112, two photo-cells 54 and 55 are provided at different distances in front of the needle 4. Of these the photo-cell 54 responds to passage of the work edges 101 and 102 and the other photo-cell 55 responds to passage of the work edge 105, a switching pulse being delivered to initiate a sequential switching operation.

The collar edges to which parallel seams are formed are indicated by 100, 101 and 102, while the seams to be formed parallel thereto are indicated by 110, 111 and 112. In addition, 103 and 104 denote the edges contiguous to the short edges 100 and 102 at the protrusions 106 and 107 (intended for a button and a buttonhole) of the collarband cut as one in one-piece collars, while 105 denotes the work edge remaining without a seam.

Operation

Figure 2:
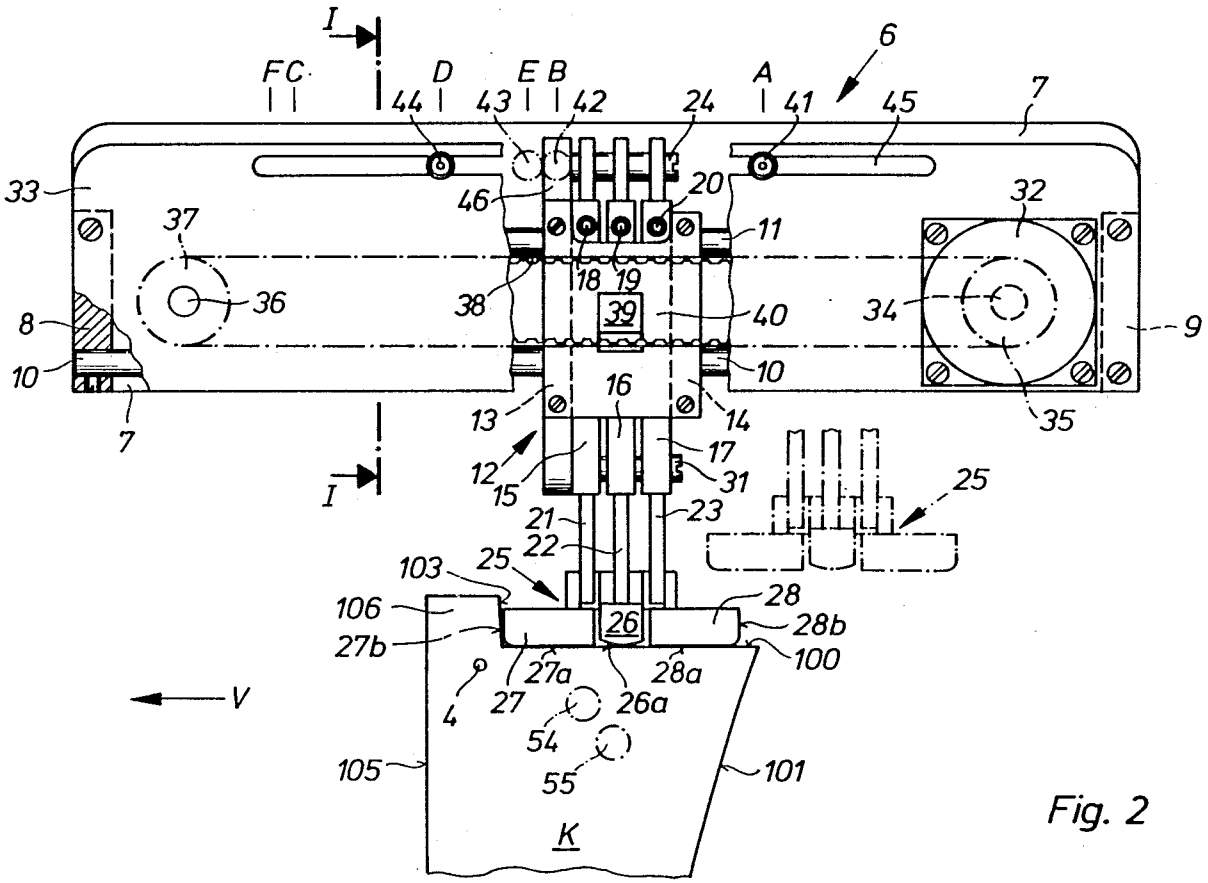
FIG. 2 is a top view of the edge guiding device.

It is assumed that the sewing machine 1 is stopped in needle-up position, the usual presser foot and the pressure piece 53 of the rotating device 47 are raised, and the edge ruler 25 is in the starting or inactive position, shown in dash-dot lines in FIG. 2, which for the switch bar 6 of sliding piece 12 is marked A, in which the bar 46 is opposite the proximity switch 41. The pneumatic cylinders 15 to 17 are vented, so that the edge ruler 25 is outside the feed path of collar K and of the protrusion 106 of the collarband. By actuation of a program selection switch (not shown) first the step motor 32 is turned on, which, via the toothed belt pulley 35 and the toothed belt 38 connected to the tapper 39, displaces the slide-piece 12 with its switch bar 46 into position B, in which the bar 46 is opposite the proximity switch 42, which thereby turns the step motor 32 off. As the edge ruler 25 is outside the feed path of collar K and of the protrusion 106, the collar K—having been placed in readiness already during the preceding sewing operation at a distance before the sewing machine, oriented according to stops or markings—can be supplied to the sewing machine by an automatic feed device of known design, as used for instance in connection with the Pfaff sewing system K1.3557, parallel to the work feed direction (arrow V) and exactly positioned relative to the needle 4. As soon as this has been done, the pneumatic cylinders 15 to 17 are pressurized via their connections 18 to 20, whereby the edge ruler 25 with the sections 26, 27 and 28 fastened at the piston rods 21 to 23, is moved counter to the action of the return springs disposed in the cylinder housings into the operating position shown in solid lines according to FIG. 2. In this position the collar edge 100 applies over almost the entire length against the guide faces 26*a*, 27*a*, 28*a*, while edge 103 of the collarband applies against guide face 27*b*. The sewing machine 2 and the step motor 32 are turned on after the lowering of the conventional presser for the formation of the seam 110.

Figure 3:
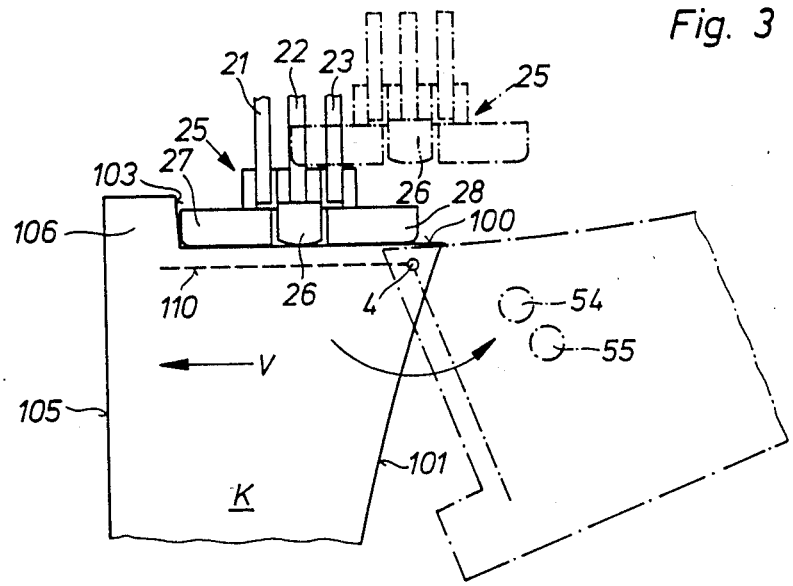

During the seam formation operation, the edge ruler is moved by the step motor 32 synchronously with the work displacement in the work feed direction V, into the position shown in solid lines in FIG. 3, which corresponds to the position C (FIG. 2) of bar 46 of slide-piece 12. Thus the collar K is guided along the edge ruler 25 during the formation of seam 110, from the beginning.

Before the end position at the end of seam 110 has been reached, the collar edge 101 passes the photo-cell 54 consisting of a light emitter and a receiver, the light emitted by the emitter being reflected from a reflection surface on the work support surface to the receiver, whereby the latter delivers a switching pulse to trigger a sequential switching operation by which first the machine speed is reduced, a stitch counter is activated; on reaching the corner stitch of seam 110 the feeder is lowered and the sewing machine 1 is stopped in needle down position. A control arrangement of this kind has been described in U.S. Pat. No. 4,491,080. In the present example furthermore the step motor 32 is turned off, the supply of compressed air to the pneumatic cylinders 15 to 17 is interrupted so that the edge ruler 25 is pulled back from the collar edge 100 in order not to hinder the subsequent turning of collar K, further the step motor 32 is turned on again, which then via the belt drive 35 to 38, moves the slide-piece 12 and hence the edge ruler 25 into the position shown in dash-dot lines in FIG. 3. In this position the switching bar 46 is in position D (FIG. 2) and is opposite the proximity switch 44, turning the step motor 32 off. Further, the presser foot is raised, the compressed air supply to the pneumatic cylinder 51 is turned on, so that the pressure piece 53 is lowered onto the collar K and the step motor 48 of the rotating device 47 is turned on, whereby the collar K is rotated about the inserted needle 4 as pivot axis into the position shown in dash-dot lines in FIG. 3. Then, by interruption of the compressed air supply to the pneumatic cylinder 51, the pressure piece 53 is lifted off the collar K by the return spring in the cylinder space and is rotated back into the starting position by the step motor 48. The cloth presser is lowered and finally the compressed air supply to the pneumatic cylinder 16 is turned on, whose piston rod 22 displaces the central section 26 of the edge ruler 25 into the operating position according to FIG. 4, in which the collar edge 101 abuts against the guide face 26*a* and the sewing machine 1 is turned on for the formation of seam 111.

Figure 4:
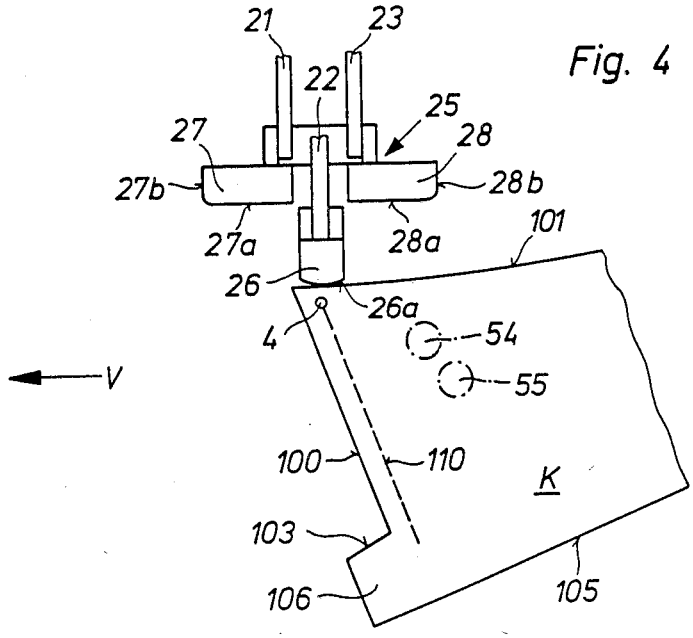

While seam 111 is being formed, the central section 26 of ruler 25 remains in its operating position per FIG. 4, oriented to the center of the needle. This considerably facilitates the guiding of the collar edge 101, which is usually curved.

When, before reaching the end of seam 111 at the second collar corner, the seam edge 102 passes the photo-cell 54, the latter delivers, as in the case of the first collar corner, a switching pulse for actuating the sequential circuit for the processes then occurring essentially in the same manner as for the first collar corner.

The difference in the sequential switching operation are that the central section 26 of edge ruler 25 is pulled back into the position shown in dash-dot lines in FIG. 5 before operation of the rotating device 47, by interruption of the compressed air supply to the pneumatic cylinder 16 by the return spring in the cylinder housing, and after rotation of collar K by device 47 into the position shown in dash-dot lines in FIG. 5 the edge ruler 25 is moved by the step motor 32 into the operating position shown in solid lines in FIG. 6, in which the collar edge 102 applies against all three guide faces 26*a*, 27*a* and 28*a* and edge 104 applies against the guide face 28*b* of the outer section of edge ruler 25, and in which, in position E, the switching bar 46 of slide-piece 12 is opposite the proximity switch 43 which turns the step motor 32 off in this position. By way of preparation, the photo-cell 54 is turned off by the sequential circuit and instead the photo-cell 55 is switched in, because the following seam 112 ends at a greater distance from the unstitched edge 105 of collar K than the seams 110 and 111 of the collar edge 101 or respectively 102.

For the formation of the last seam 112, with the switching on of the sewing machine 1 the step motor 32 is turned on, by which the edge ruler 25 is moved synchronomously with the work displacement parallel to the work feed direction, arrow V, into the position shown in dash-dot lines in FIG. 6, in which the switching bar 46 of slide-piece 12 assumes the position marked F, FIG. 2.

When, during this shift movement, the collar edge 105 passes the photo-cell 55, the light emitted by the light matter is reflected from the reflection face on the work support surface to the receiver. A switching pulse is thereby sent to the control circuit for initiating the stopping process and for terminating the sewing process. The sewing machine 1 is stopped at the end of the seam in a needle up position, the threads are cut off, the pressure foot is raised and the pneumatic cylinders 15 to 17 are vented, the edge ruler 25 is thus pulled back from the collar edge 102 by the return springs in the cylinder housings and moved back to the starting position marked A (shown in dash-dot lines in FIG. 2) for the switching bar 46 of slide-piece 12 by the step motor 32, in which position the switching bar 46 actuates the proximity switch 41, which turns the step motor 32 off. The sewn collar K can be removed and the next collar, which was in the meanwhile oriented in ready position, can be supplied to the sewing machine 1 and thereafter the described cycle can be repeated.

While a specific embodiment of the invention has been shown and described in detail to illustrate the application of the principles of the invention, it will be understood that the invention may be embodied otherwise without departing from such principles.

What is claimed is:

1. An edge guiding device for guiding a workpiece to be sewn, the workpiece having edges extending at angles to each other and defining at least one inside corner, the workpiece being movable in a feed direction for having seams which are parallel to the edges formed on the workpiece, the edge guiding device comprising an edge ruler defining a guide face extending in a substantially vertical plane parallel to the workpiece feed direction, an actuator connected to said edge ruler for moving said edge ruler between an active and an inactive position, said edge ruler being formed by a central section and two outer sections disposed on opposite sides of said central section, said sections together defining said guide face with each section carrying a portion of said guide face, said edge ruler being movable synchronously with displacement of the workpiece in the feed direction during formation of seams beginning or ending at the inside corner of the workpiece, said actuator including separately controllable actuator portions connected to said central section and to said two outer sections for jointly and independently moving said central and two outer sections.

2. An edge guiding device according to claim 1, wherein said outer sections of said edge ruler include outer abutment faces extending substantially transversely to said guide face for at least one workpiece edge forming the inside corner.

3. An edge guiding according to claim 1, wherein said portion of said guide face formed by said central section is arched.

4. A guiding device according to claim 1 including at least one slide rod extending in the workpiece feed direction, a slide-piece mounted for sliding movement in the feed direction on said slide rod, said actuator being mounted on said slide-piece and carrying said sections of said edge ruler for moving said sections transversely to the workpiece feed direction, said actuator including belt drive means connected to said slide for moving said slide on said slide rod.

5. An edge guiding device according to claim 4, including a plurality of limit stitches spaced along the feed direction each activatable by passage of said slide, said limit switches being connected to said belt drive means for stopping said belt drive means.

6. An edge guiding device according to claim 1, including limit switch means disposed along the workpiece feed direction, a slide movable along the workpiece feed direction and interacting with said limit switch means, drive means for moving said slide, said drive means being connected to said limit switch means for stopping movement of said slide, said slide carrying said edge ruler.

7. An edge guiding device according to claim 3 wherein said outer sections each have outer abutment faces extending substantially transversely to said guide face for at least one of the workpiece edges forming the inside corner.

8. An edge guiding device according to claim 7 including guide rod means mounted at a fixed location with respect to said edge ruler and extending in the workpiece feed direction, a slide mounted for sliding movement in the feed direction on said guide rod means, drive means connected between said guide rod means and said slide for moving said slide in the feed direction, said actuator comprising a cylinder connected to said slide for each section of said edge ruler, each cylinder having a piston therein connected to one of said sections of said edge ruler.

9. An edge guiding device according to claim 8 wherein said guide rod means comprise a mount having two guide rods connected thereto extending in the feed direction, said mount carrying a plurality of limit switches extending in the feed direction, said slide interacting with said limit switches, each limit switch being connected to said drive means for deactivating said drive means when said slide reaches a limit switch.

10. An edge guiding device according to claim 9 wherein said slide has a pair of spaced-apart legs, one of said legs having a projection for interacting with said limit switches and being connected to said cylinders for fixing said cylinders with respect to said slide, each piston having a slot therein and a stop extending through said slots of said pistons and being fixed to said one leg of said slide.

* * * * *